US007980538B1

(12) United States Patent
Weiby

(10) Patent No.: US 7,980,538 B1
(45) Date of Patent: Jul. 19, 2011

(54) CLAMPING JIG

(75) Inventor: Michael Weiby, Bartlett, IL (US)

(73) Assignee: Sears Brands, L.L.C., Hoffman Estates, IL (US)

( * ) Notice: Subject to any disclaimer, the term of this patent is extended or adjusted under 35 U.S.C. 154(b) by 981 days.

(21) Appl. No.: 11/852,462

(22) Filed: Sep. 10, 2007

(51) Int. Cl.
*B25B 1/00* (2006.01)

(52) U.S. Cl. ..... 269/165; 269/86; 269/216; 248/680

(58) Field of Classification Search ..... 269/156, 269/86, 216, 250, 251, 289 R, 302.1, 43, 269/45; 248/680, 681, 346.03; 144/269, 144/1.1, 2.1
See application file for complete search history.

(56) References Cited

U.S. PATENT DOCUMENTS

| | | | | | |
|---|---|---|---|---|---|
| 7,892 | A | * | 1/1851 | Simpson | 269/250 |
| 15,170 | A | * | 6/1856 | Chaffee | 269/194 |
| 85,372 | A | * | 12/1868 | Elliott | 269/45 |
| 650,635 | A | * | 5/1900 | Crouner | 29/560.1 |
| 713,189 | A | * | 11/1902 | Yates | 269/250 |
| 868,966 | A | * | 10/1907 | Chase | 269/45 |
| 902,230 | A | * | 10/1908 | Holland | 269/40 |
| 1,335,721 | A | * | 4/1920 | Bergstrom | 269/244 |
| 2,430,366 | A | * | 11/1947 | Porterfield | 269/146 |
| 4,047,333 | A | | 9/1977 | Riegelman | |
| 4,304,399 | A | * | 12/1981 | Szugda | 269/88 |
| 4,575,060 | A | * | 3/1986 | Kitagawa | 269/43 |
| 4,684,113 | A | * | 8/1987 | Douglas et al. | 269/21 |
| 4,824,086 | A | * | 4/1989 | Rickling et al. | 269/156 |
| 4,850,769 | A | * | 7/1989 | Matthews | 410/105 |
| 4,927,126 | A | * | 5/1990 | Hoffman | 269/60 |
| D310,376 | S | | 9/1990 | Johnsen | |
| 4,962,918 | A | * | 10/1990 | Yang | 269/156 |
| D312,315 | S | | 11/1990 | Westphal et al. | |
| 5,092,427 | A | * | 3/1992 | MacMillan | 182/20 |
| D340,465 | S | | 10/1993 | Guertin | |
| 5,330,167 | A | * | 7/1994 | Plumb | 269/43 |
| 5,337,641 | A | * | 8/1994 | Duginske | 83/468 |
| D359,565 | S | | 6/1995 | Hallsten | |
| 5,488,803 | A | | 2/1996 | George | |
| 5,697,601 | A | * | 12/1997 | Gurule | 269/43 |
| 5,768,966 | A | * | 6/1998 | Duginske | 83/468.7 |
| 5,810,342 | A | * | 9/1998 | Kitamura et al. | 269/60 |
| D402,049 | S | | 12/1998 | Goodchild | |
| 5,884,904 | A | | 3/1999 | Martini | |
| 5,890,524 | A | * | 4/1999 | Tucker et al. | 144/371 |

(Continued)

FOREIGN PATENT DOCUMENTS

GB 2299774 * 10/1996

*Primary Examiner* — George Nguyen
(74) *Attorney, Agent, or Firm* — Greenberg Traurig, LLP

(57) ABSTRACT

An embodiment of the present invention is directed to a jig for holding a workpiece using forces provided by a clamp having a first clamping member, a second clamping member, and a connecting member operable for moving the first clamping member relative to the second clamping member. The jig includes an elongated base member and an elongated support member extending upward from the base member. The support member has a clamp engagement surface for engaging the first clamping member of the clamp, a generally vertically oriented upper surface disposed opposite of the clamp engagement surface for engaging a lateral side of the workpiece, a generally horizontally oriented support surface extending from the support member disposed below the upper surface for engaging a bottom side of the workpiece, and an aperture sized and arranged to accept the connecting member of the clamp.

19 Claims, 3 Drawing Sheets

U.S. PATENT DOCUMENTS

| | | | | |
|---|---|---|---|---|
| 6,032,939 | A * | 3/2000 | Chen | 269/249 |
| D424,711 | S | 5/2000 | Johnsson et al. | |
| 6,189,457 | B1 | 2/2001 | Campfield | |
| 6,237,907 | B1 * | 5/2001 | Lawrence | 269/287 |
| 6,299,392 | B1 * | 10/2001 | Swanson | 408/234 |
| 6,336,247 | B1 | 1/2002 | Schnoor | |
| 6,402,131 | B1 * | 6/2002 | Baculy | 269/168 |
| 6,412,158 | B1 * | 7/2002 | Moore | 29/249 |
| D474,286 | S | 5/2003 | Gregori | |
| 6,557,601 | B1 * | 5/2003 | Taylor | 144/253.1 |
| 6,595,508 | B2 * | 7/2003 | Duncan | 269/242 |
| D497,010 | S | 10/2004 | Brabeck | |
| 6,880,442 | B2 * | 4/2005 | Duginske | 83/468.7 |
| 6,958,423 | B2 | 10/2005 | Parks et al. | |
| D511,219 | S | 11/2005 | Cleary | |
| D512,893 | S | 12/2005 | Cowan | |
| D519,543 | S | 4/2006 | Walker et al. | |
| D522,147 | S | 5/2006 | Morton et al. | |
| 7,055,813 | B2 | 6/2006 | Hexamer, Jr. | |
| 7,147,412 | B2 | 12/2006 | Davis | |
| D541,953 | S | 5/2007 | Deleu | |
| D554,773 | S | 11/2007 | Antonic | |
| D554,978 | S | 11/2007 | Radke | |
| 7,753,350 | B2 * | 7/2010 | Barziza | 269/99 |
| 2006/0163804 | A1 * | 7/2006 | Serlachius | 273/108.51 |
| 2008/0006976 | A1 | 1/2008 | Riley | |
| 2008/0010902 | A1 | 1/2008 | Kim | |

* cited by examiner

CLAMPING JIG

BACKGROUND

1. Field

Embodiments generally relate to the field of clamping devices.

2. Background

In the woodworking field, as well as other fields, it is often necessary to glue or otherwise adhere two workpieces together. As should be appreciated, woodworking glue generally does not dry instantly. Therefore it becomes necessary to maintain the workpieces in the desired position for a period of time while the glue or other adhesive dries/hardens. Generally this is achieved by clamping the pieces together using one or more pipe clamps, bar clamps, or the like (hereinafter referred to as "conventional clamps" or simply "clamps"), which are well-known in the art and need not be discussed at length here.

In certain situations, conventional clamps alone can be inadequate. For example, when gluing one workpiece to the edge of another, particularly a narrow edge, balancing the workpieces on clamps can be tedious because the workpieces will have a tendency to slip out of alignment. Older conventional clamps do not have feet or other means for standing them up. Consequently, the user is required to build a home-made stand to assist in balancing the workpieces. Newer conventional clamps have feet and therefore allow the user to stand them up, but do not eliminate the problem of the workpieces slipping out of alignment.

Thus, conventional tools and/or clamping devices do not provide an easy to use, stable system for holding workpieces while doing edge glue-ups.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

An embodiment of the present invention is directed to a jig for holding a workpiece using forces provided by a clamp having a first clamping member, a second clamping member, and a connecting member operable for moving the first clamping member relative to the second clamping member. The jig includes an elongated base member and an elongated support member extending upward from the base member. The support member has a clamp engagement surface for engaging the first clamping member of the clamp, a generally vertically oriented upper surface disposed opposite of the clamp engagement surface for engaging a lateral side of the workpiece, a generally horizontally oriented support surface extending from the support member disposed below the upper surface for engaging a bottom side of the workpiece, and an aperture sized and arranged to accept the connecting member of the clamp.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, and components have not been described in detail as not to unnecessarily obscure aspects of the present invention.

Overview

Generally speaking, embodiments provide a mechanism for securely positioning multiple workpieces together while the workpieces undergo an adhesion process, such as gluing, welding, or the like. This may be achieved, for example, by utilizing a plurality of jigs in conjunction with one or more conventional clamps. The jigs serve to support the workpieces and maintain their positioning while being adhered. Additionally, the jigs serve to transmit a force supplied by the clamps across a greater area of the workpieces (e.g., along an entire edge of a workpiece) than the clamps would ordinarily cover on their own.

Generally, a clamping jig has a base member that provides stability for the jig and allows the jig to stand on its own without falling over. The clamping jig also has a support member extending up from the base portion. The support member is operable to interface with one or more clamps and one or more workpieces. The support portion interfaces with multiple edges of the workpiece so as to more securely hold the workpiece in place.

Exemplary Jigs

Figure 1:
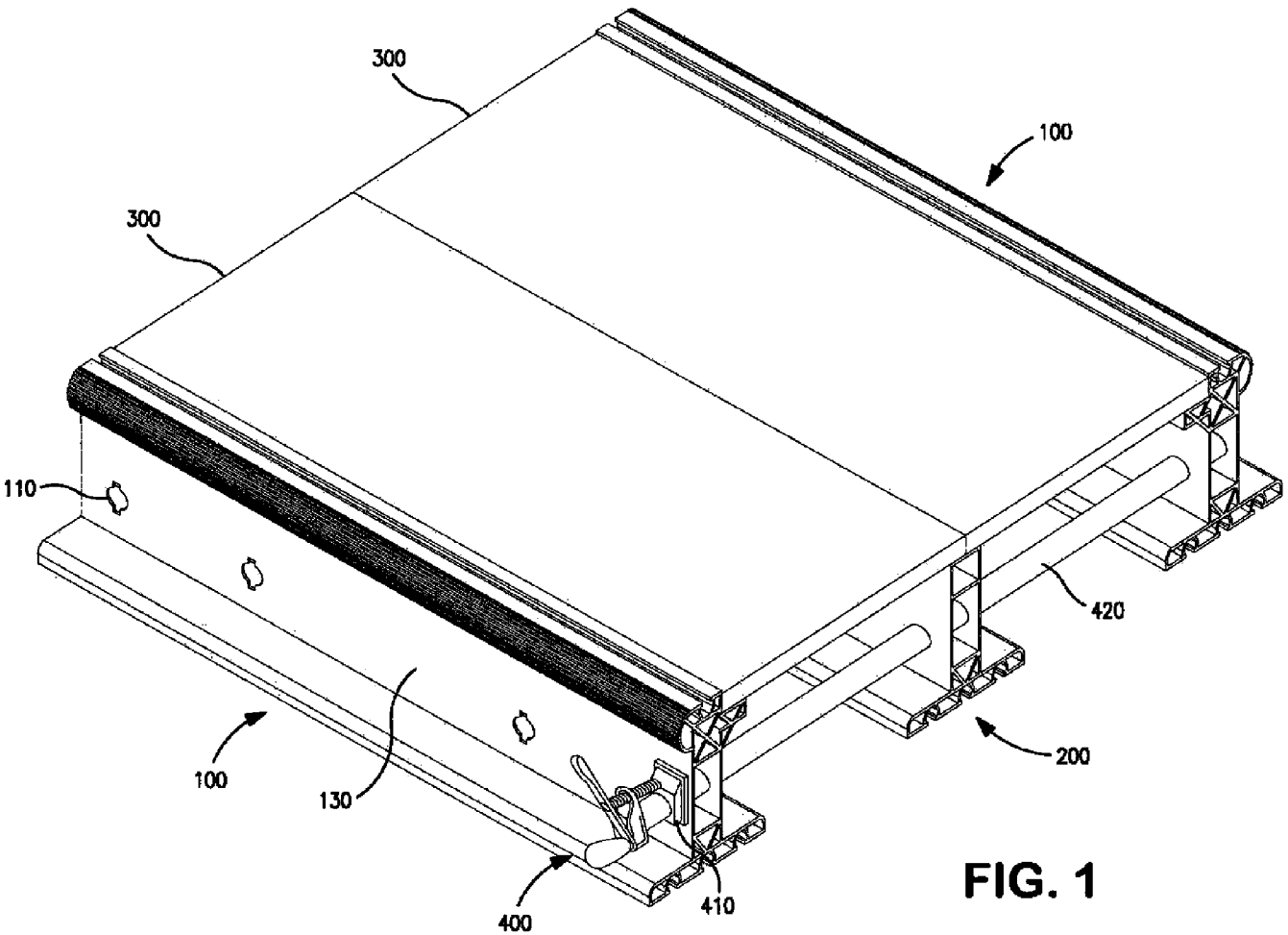
FIG. 1 illustrates a clamping system, in accordance with various embodiments of the present invention.

FIG. 1 illustrates an exemplary clamping jig system, in accordance with various embodiments of the present invention, as used in an example application. The illustrated system includes at least two end jigs 100. The end jigs 100 serve to support the workpieces 300 both vertically and horizontally. Additionally, the system may optionally include one or more intermediate jigs 200. The intermediate jigs 200 serve to vertically support one or more of the workpieces 300. It should be appreciated that the jigs 100, 200 may be formed from many different materials, including aluminum, plastic, wood, or any other suitable material.

The jigs 100, 200 include one or more apertures 110, 210 spaced along their length, which are sized and shaped to accommodate a conventional clamp 400. For example, in the illustrated embodiment, the shaft 420 of the clamp 400 is threaded through the apertures 110, 210 in jigs 100, 200. In a preferred embodiment, the position and/or spacing of an aperture 110, 210 of one jig 100, 200 is the same as another, so as to facilitate alignment of the jigs when coupled with a clamp.

As illustrated, workpieces 300 may be positioned between end jigs 100. In order to secure the workpieces in place, a clamp 400 may be inserted through opposing apertures 110 of the respective end jigs. Jaws 410 of the clamp 400 interface with respective clamping surfaces 130 of the end jigs 100. Upon tightening of the clamp jaws 410, the force exerted by the jaws 410 of the clamp 400 is transferred by the end jigs 100 and distributed along vertical edges of the workpieces, thereby applying a more uniform pressure to the workpieces 300.

Depending on the relative sizes and shapes of the workpieces 300, it may be desirable to provide additional vertical support at a location between the end jigs 100 to one or more of the workpieces 300. Such additional support may be achieved with the addition of one or more intermediate jigs 200. For example, in the illustrated embodiment, intermediate jig 200 is positioned under the seam between the two workpieces 300, thereby preventing the workpieces from sagging. This is particularly important when the boards are being coupled together by an adhesive that requires time to set. Although a single intermediate jig 200 is used in the illustrated embodiment, it should be appreciated that any number of intermediate jigs 200, may be used, depending on the particular application. It should be further appreciated that some applications may not require an intermediate jig 200 at all.

Figure 2A:
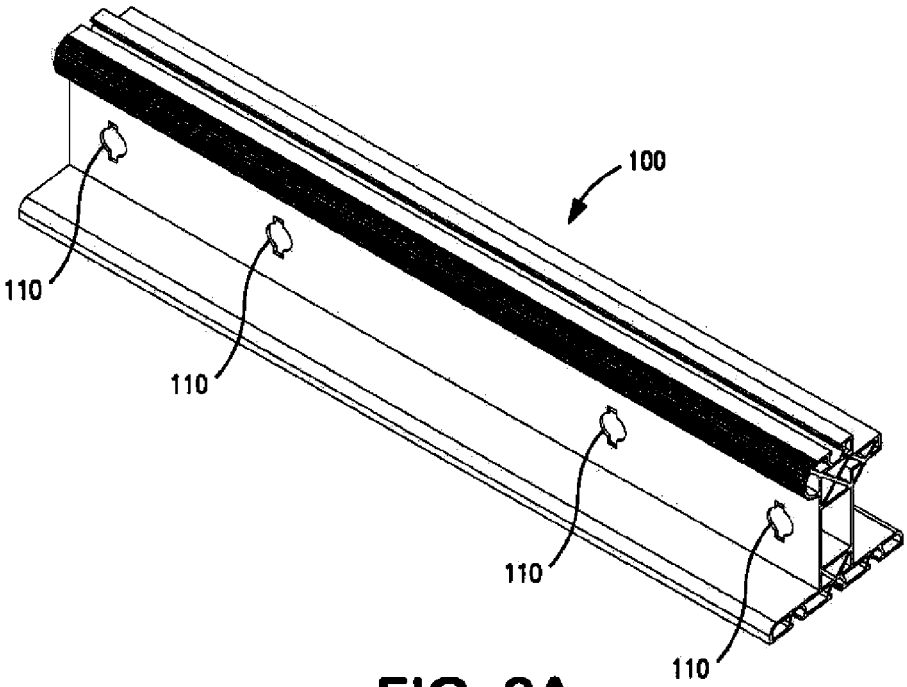
FIG. 2A is an isometric view of a clamping jig, in accordance with various embodiments of the present invention.
Figure 2B:
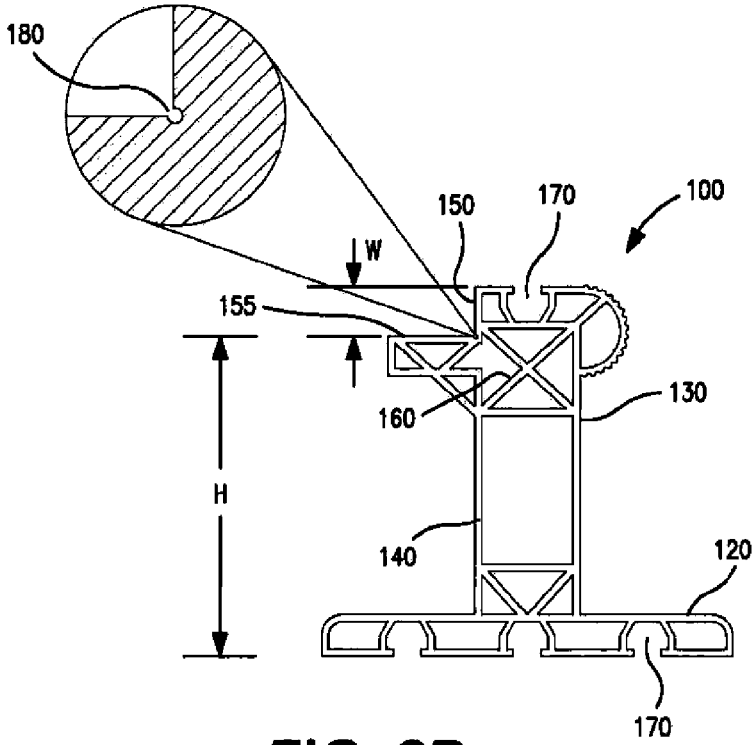
FIG. 2B is an end-view of the clamping jig, in accordance with various embodiments of the present invention.

FIGS. 2A and 2B respectively illustrate isometric and end-views of an end-type clamping jig, or end jig 100, in accordance with an embodiment of the present invention. The end jig 100 may be provided as a standalone apparatus, as a pair, or in any other configuration.

The end jig 100 includes a base member 120. In one embodiment, the base member 120 is sufficiently wide so as to allow the end jig 100 to stand on its own. The end jig 100 also includes an elongated support member 140 extending upward from the base member 120. The support member 140 has a generally vertically oriented upper surface 150 disposed opposite the clamp engagement surface 130 and a generally horizontally oriented support surface 155 disposed below the upper surface 150. During use, the support surface 155 engages a bottom side of a workpiece 300, and the upper surface 150 engages a lateral side of the workpiece 300. In one embodiment, the width W of the upper surface is approximately ¾ inches. Various structures may be implemented to achieve the upper and support surfaces. For example, the support surface 155 may extend, in whole or in part, laterally from the main body of the support member 140, as illustrated. Alternatively, the support surface 155 may extend, in whole or in part, into the main body of the support member 140, so as to form a notch into the main body of the support member 140 with the upper surface 150.

The end jig 100 further includes one or more apertures 110 spaced along its length and sized to accommodate a shaft 420 of a conventional clamp 400. In one embodiment, the apertures 110 have a "key-hole" shape, such as illustrated in FIG. 2A, so as to securely accept both the rounded shaft of a conventional pipe clamp or the flat, rectangular shaft of a conventional bar clamp.

The end jig 100 may include additional features to enhance its stability. For example, a webbing or other support structure 160 may be provided within the end jig 100. The support structure 160 serves to enhance the structural strength of the end jig 100 while at the same time minimizing the overall weight of the jig.

The end jig 100 may also include a number of grooves 170. In one embodiment, the grooves 170 are conventional T-tracks. The grooves 170 may be located, for example, within the base member 120 opposite of the support member 140, within the support member 140 opposite of the base member 120, or both. The grooves 170 in the base member 120 may be operable to mate with a number of other devices, such as hex bolts, carriage bolts, tracks, and the like, so as to secure the end jig 100 to a work surface. The grooves 170 in the support member 140 may be operable to mate with similar devices. One potential use of the grooves 170 in the support member 140 may be for affixing an apparatus to the end jig 100 to prevent the workpieces 300 from buckling upward due to pressure exerted by the clamp 400 and of the end jigs 100. For example, with reference to FIG. 1, a board, a piece of scrap, or other device may be fastened across the workpieces 300 and the jigs 100, 200, and secured to the upper grooves 170 of the end jigs 100 with a hex bolt and nut, thereby serving to hold the workpieces 300 down flat.

In one embodiment, the upper surface 150 and the support surface 155 are substantially perpendicular. From a practical standpoint, machining a perfectly square corner at the intersection between the upper surface 150 and the support surface 155 is quite difficult. In practice, a machined intersection would likely have some degree of radius to it, which may cause a corner of the workpiece 300 to prevent the jig 100 from achieving maximum contact with the workpiece 300. In order to resolve such issues, the end jig 100 may also include an undercut region 180 at the intersection of the upper surface 150 and the support surface 155. The undercut region 180 allows a machined end jig 100 to accept a square corner of a workpiece 300 while also maintaining maximum contact with the workpiece 300. Although illustrated as a rounded future, it should be appreciated that numerous alternate environments are possible involving varying sizes and shapes of the undercut region 180.

Figure 3A:
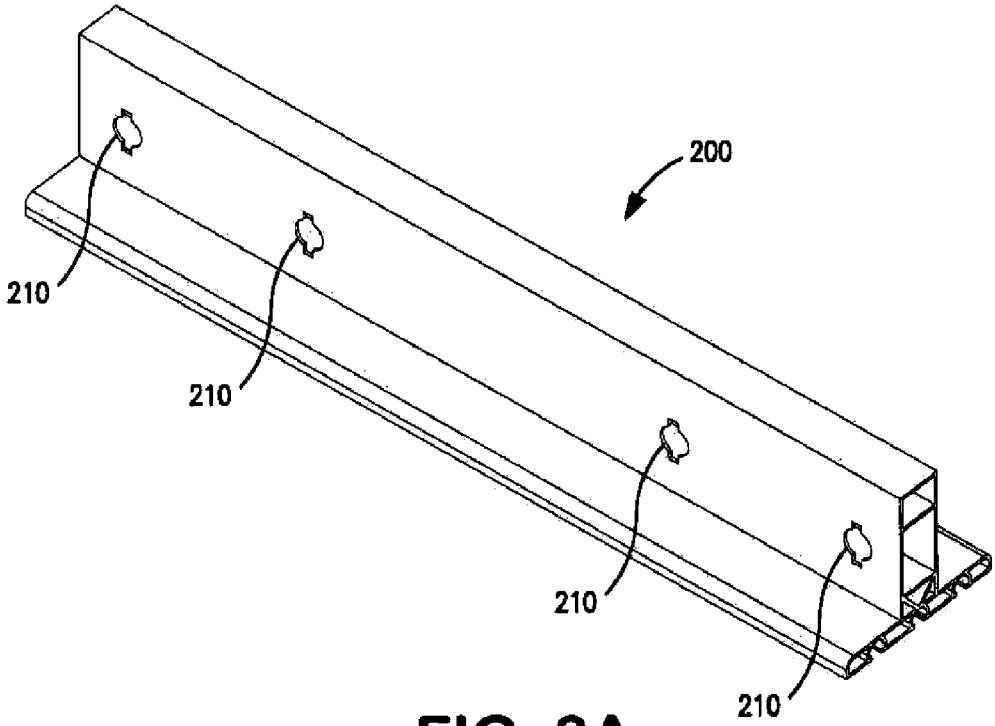
FIG. 3A is an isometric view of a support apparatus for use with a clamping jig, in accordance with various embodiments of the present invention.
Figure 3B:
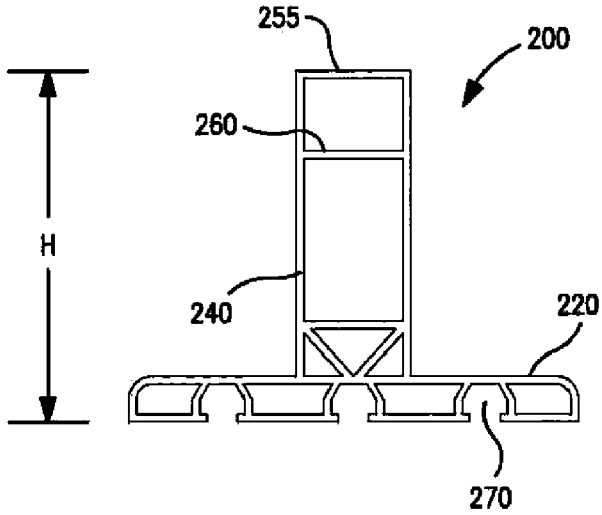
FIG. 3B is an end-view of the support apparatus, in accordance with various embodiments of the present invention.

FIGS. 3A and 3B respectively illustrate isometric and end-views of an intermediate-type clamping jig, or intermediate jig 200, in accordance with an embodiment of the present invention. The intermediate jig 200 may be provided as a standalone apparatus, as a clamping system along with one or more end jigs 100, or in any other configuration.

Similar to the end jig 100 described above with reference to FIGS. 2A-2B, the intermediate jig 200 includes a base member 220. In one embodiment, the base member 220 is sufficiently wide so as to allow the intermediate jig 200 to stand on its own. The intermediate jig 200 also includes an elongated support member 240 extending upward from the base member 220. The support member 240 has a generally horizontally oriented support surface 255 disposed opposite of the base member 220. During use, the support surface 255 engages a bottom side of a workpiece 300.

The intermediate jig 200 further includes one or more apertures 210 spaced along its length and sized to accommodate a shaft 420 of a conventional clamp 400. In one embodiment, the apertures 210 of the intermediate jig 200 may also have a "key-hole" shape, such as illustrated in FIG. 3A, so as to securely accept both the rounded shaft of a conventional pipe clamp or the flat, rectangular shaft of a conventional bar clamp.

The intermediate jig 200 may include additional features to enhance its stability. For example, a webbing or other support structure 260 may be provided within the intermediate jig 200. The support structure 260 serves to enhance the structural strength of the intermediate jig 200 while at the same time minimizing the overall weight of the jig.

The intermediate jig 200 may also include a number of grooves 270. In one embodiment, the grooves 270 are conventional T-tracks. The grooves 270 may be located, for example, within the base member 220 opposite of the support member 240. The grooves 270 in the base member 220 may be operable to mate with a number of other devices, such as hex bolts, carriage bolts, tracks, and the like, so as to secure the intermediate jig 200 to a work surface.

It is appreciated that in order to function together most effectively, the respective support surfaces 155, 255 of end jigs 100 and intermediate jigs 200 preferably should have corresponding heights. For example, and with reference to FIG. 2B, the support surface 155 and a bottom surface of the base member 120 together define a first height H. similarly, referring to FIG. 3B, the support surface 255 and a bottom surface of the base member 220 together define a second height, which in a preferred embodiment is also H. Accordingly, when the respective support surfaces 155, 255 have substantially the same height, a workpiece 300 laid across the jigs 100, 200 shall be substantially level.

Thus, the described embodiments provide a stable and secure mechanism for positioning multiple workpieces while the workpieces are being adhered. The clamping jigs and systems of the same according to various embodiments may be used in combination with conventional clamps. By providing surfaces that engage the workpieces that are spatially separate from surfaces that engage the clamps, the described embodiments are able to more uniformly distribute forces applied by the clamps, thereby reducing tendencies for the workpieces to shift and/or pivot during adhesion.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A jig for holding a workpiece using forces provided by a plurality of clamps, each having a first clamping member, a second clamping member, and a connecting member operable for moving the first clamping member relative to the second clamping member, the jig comprising:

an elongated base member that allows the jig to stand on its own on a generally flat surface; and an elongated support member extending upward from the base member, the support member having a clamp engagement surface for engaging the first clamping member of the clamp, a generally vertically oriented upper surface disposed opposite of the clamp engagement surface for engaging a lateral side of the workpiece, a generally horizontally oriented support surface extending from the support member disposed below the upper surface for engaging a bottom side of the workpiece, and plurality of apertures sized and arranged to accept the connecting members of the plurality of clamps.

2. The jig as recited in claim 1 wherein the elongated base member and the elongated support member are integrally formed from an aluminum material.

3. The jig as recited in claim 1 wherein the elongated base member and the elongated support member are integrally extrusion molded using a plastic material.

4. The jig as recited in claim 1 wherein the elongated support member further comprises:

a first side;

a second side spaced from the first side; and a support structure disposed between the first side and the second side for providing structural stability to the elongated support member against the forces provided by the plurality of clamps.

5. The jig as recited in claim 1 wherein the base member comprises a groove opposite of the support member, the groove operable to mate with a device so as to secure the jig to a work surface to prevent movement and/or deformation of the jig.

6. The jig as recited in claim 5 wherein the groove comprises a T-track.

7. The jig as recited in claim 1 wherein the support member comprises a groove opposite of the base member, the groove operable to mate with a device so as to secure the jig to a work surface to prevent movement and/or deformation of the jig.

8. The jig as recited in claim 7 wherein the groove comprises a T-track.

9. The jig as recited in claim 1 wherein the upper surface and the support surface are substantially perpendicular with respect to each other.

10. The jig as recited in claim 1 wherein the upper surface is approximately ¾ inches wide.

11. The jig as recited in claim 1 wherein the support member further includes an undercut region at an imaginary intersection of the upper surface and the support surface, wherein the undercut region is sized and arranged to prevent a corner of the workpiece from interfering with the engagement of the workpiece with the support surface and the upper surface.

12. A support apparatus for supporting a workpiece being held at a jig using forces provided by a plurality of clamps, each having a first clamping member, a second clamping member, and a connecting member operable for moving the first clamping member relative to the second clamping member, the jig having a generally horizontally oriented first support surface for engaging a bottom side of the workpiece and a first plurality of apertures sized and arranged to accept the connecting members of the plurality of clamps, the first support surface having a height relative to a bottom surface of the jig, the support apparatus comprising:

an elongated base member that allows the jig to stand on its own on a generally flat surface; and an elongated support member extending upward from the base member, the support member having a generally horizontally oriented top surface for engaging the bottom side of the workpiece and a second plurality of apertures sized and arranged to accept the connecting members of the plurality of clamps, the top surface having said height relative to a bottom surface of the base member.

13. The support apparatus as recited in claim 12 wherein the base member and the support member are integrally formed from an aluminum material.

14. The support apparatus as recited in claim 12 wherein the base member and the support member are integrally extrusion molded using a plastic material.

15. The support apparatus as recited in claim 12 wherein the support member further comprises:

a first side;

a second side spaced from the first side; and a support structure disposed between the first side and the second side for providing structural stability to the support member.

16. The support apparatus as recited in claim 12 wherein the base member comprises a groove opposite of the support member, the groove operable to mate with a device so as to secure the jig to a work surface to prevent movement and/or deformation of the jig.

17. The support apparatus as recited in claim 16 wherein the groove comprises a T-track.

18. A clamping system for holding a first workpiece and a second workpiece using forces provided by a plurality of clamps, each having a first clamping member, a second clamping member, and a connecting member operable for moving the first clamping member relative to the second clamping member, the clamping system comprising:

a first jig comprising:

a first elongated base member that allows the jig to stand on its own on a generally flat surface; and a first elongated support member extending upward from the first base member, the first support member having a first clamp engagement surface for engaging the first clamping members of the plurality of clamps, a generally vertically oriented first upper surface disposed opposite of the first clamp engagement surface for engaging a first lateral side of the first workpiece, a generally horizontally oriented first support surface extending from the first support member and disposed below the first upper surface for engaging a first bottom side of the first workpiece, and a first plurality of apertures sized and arranged to accept the connecting members of the plurality of clamps;

a second jig comprising:

a second elongated base member that allows the jig to stand on its own on the generally flat surface; and a second elongated support member extending upward from the second base member, the second support member having a second clamp engagement surface for engaging the second clamping members of the plurality of clamps, a generally vertically oriented second upper surface disposed opposite of the second clamp engagement surface for engaging a second lateral side of the second workpiece, a generally horizontally oriented second support surface extending from the second support member and disposed below the second upper surface for engaging a second bottom side of the second workpiece, and a second plurality of apertures sized and arranged to accept the connecting members of the plurality of clamps; and a support apparatus comprising:

a third elongated base member that allows the support apparatus to stand on its own on the generally flat surface; and a third elongated support member extending upward from the third base member, the third support member having a generally horizontally oriented top surface for engaging the first bottom side of the first workpiece and the second bottom side of the second workpiece, the third support member further having a third plurality of apertures sized and arranged to accept the connecting members of the plurality of clamps.

19. The clamping system as recited in claim 18 wherein the first support surface of the first jig has a first height relative to a first bottom surface of the first base member, the second support surface of the second jig has a second height relative to a second bottom surface of the second base member, the top surface of the support apparatus has a third height relative to a third bottom surface of the third base member, and wherein further the first, second, and third heights are substantially the same.

* * * * *